United States Patent [19]

Bowman

[11] Patent Number: 4,886,308

[45] Date of Patent: Dec. 12, 1989

[54] HASP FASTENER UNIT

[76] Inventor: Robert Bowman, 4611 Mediterranean, Wildwood, N.J. 08260

[21] Appl. No.: 234,272

[22] Filed: Aug. 19, 1988

[51] Int. Cl.[4] ..... E05C 19/08

[52] U.S. Cl. ..... 292/281; 16/124; 292/341.18

[58] Field of Search ..... 70/2–13; 16/124, 126, 268; 292/281–287, DIG. 60, 341.18

[56] References Cited

U.S. PATENT DOCUMENTS

| | | | |
|---|---|---|---|
| 728,093 | 5/1903 | Ellingson | 292/281 |
| 1,546,840 | 7/1925 | Kubes | 292/281 |
| 1,566,662 | 12/1925 | Fairand | 292/281 |
| 1,690,408 | 11/1928 | Hasenflue | 292/281 |
| 1,726,162 | 8/1929 | Pique | 70/11 |
| 1,799,861 | 4/1931 | Muzzio | 292/281 |
| 2,067,255 | 1/1937 | Bittorf | 292/281 |
| 2,183,834 | 12/1939 | Ferris | 292/283 |

FOREIGN PATENT DOCUMENTS

| | | | |
|---|---|---|---|
| 740578 | 10/1943 | Fed. Rep. of Germany | 292/281 |
| 65151 | 2/1950 | Netherlands | 292/281 |

*Primary Examiner*—Lloyd A. Gall

*Attorney, Agent, or Firm*—Steele, Gould & Fried

[57] ABSTRACT

A hasp fastener unit for correcting alignment problems with a hinged hasp member includes a keeper plate having a raised portion defining a substantially concave interior surface and having an eye member passage. An end member has a base portion adapted to be positioned in a space defined by the concave surface, and has an outer end extending through the eye member passage which is pivotal within the eye member passage. Abutment portions of the base are adapted to contact the concave interior surface to limit the pivotal range of motion of the eye member with respect to the keeper plate. The base portion is preferably formed from a substantially planar piece that is slit to define legs. The legs are bent with respect to one another to form the abutment portion.

10 Claims, 1 Drawing Sheet

HASP FASTENER UNIT

BACKGROUND OF THE INVENTION

1. Field of the Invention

This invention relates to a hasp, and more particularly to a hasp fastener construction.

2. Description of the Prior Art

Hasps are generally comprised of two sections which can be referred to as a hasp fastener unit and a hinged hasp member. These two sections are fixed to surfaces which are to be joined to one another, for example, the hinged hasp member is attached to a door and the hasp fastener unit is attached to a door jamb. Typical hasp fastener units include a keeper plate and an eye member. The keeper plate is fastened to the surface and the eye member has an opening for receiving a padlock or other suitable fastening device. The hinged hasp member has an opening dimensioned to receive the eye member such that the hinged hasp member can be positioned over the hasp fastener unit. A padlock or other suitable fastening device is then connected to an opening in the eye member to prevent removal of the hinged hasp member from the hasp fastener unit, and to thereby secure the surfaces together.

Alternative hasps have been designed. Bittorf, U.S. Pat. No. 2,067,255, discloses a hasp fastener unit with an eye member connected to the keeper plate by a swivel construction. The eye member can swivel between a first position, in which an opening in the hinged hasp member can pass freely over the eye member, and a second position, in which the eye member prevents an un-coupling of the hinged hasp member from the hasp fastener unit.

Frantz, U.S. Pat. No. 1,623,050, discloses a hasp construction in which the hasp fastener unit has an eye member which slides back and forth in an opening in the keeper plate. Un-coupling of the hinged hasp member from the hasp fastener unit is prevented by sliding a shoulder formed in the eye member over a portion of the hinged hasp member.

Hasenflue, U.S. Pat. No. 1,690,408, discloses a hasp fastener unit that is formed by closing flanges in a keeper plate over a base portion of the eye member.

Roper, U.S. Pat. No. 4,079,974, discloses a hasp fastener unit with an eye member which is pivotally mounted to protect the hasp from a twisting, shearing attack.

The hinged hasp member does not always align correctly with the eye member of the hasp fastener unit. The prior art does not address alignment problems of the eye member with the hinged hasp member. It would be desirable to provide a hasp that is inexpensive and easy to manufacture, yet will substantially alleviate the problem of a misfit of the eye member with the hinged hasp member.

SUMMARY OF THE INVENTION

It is an object of the invention to alleviate alignment problems between the hinged hasp member and the hasp fastener unit.

It is also an object of the invention to provide a hasp construction which can provide a selected degree of flexibility between the hinged hasp member and the hasp fastener unit.

It is another object of the invention to produce a hasp which is inexpensive to manufacture.

These and other objects are accomplished by a hasp construction with a hasp fastener unit comprising a keeper plate having an opening. The inside surface of the keeper plate is usually attached to a fixed surface such as a door frame where the hinged hasp member is fixed to the door. The keeper plate is preferably provided with a raised portion with a substantially concave interior surface which defines a space between the surface and the fixed surface to which it is attached. The keeper plate opening is positioned in the raised portion. An eye member is positioned through the opening. The eye member has a base portion and an outer end. The base portion is positioned within the raised portion of the keeper plate and is dimensioned such that it cannot pass through the keeper plate opening. The eye member can pivot within the keeper plate opening such that the outer end of the eye member has a pivotal range of motion which helps to alleviate misalignments between the hinged hasp member and the eye member of the hasp fastener unit. A padlock or other fastening device can then be positioned through a suitable opening in the eye member to secure the hasp construction together.

The base portion of the eye member is preferably formed with an abutment portion adapted to contact the interior surface to limit the pivotal range of motion. The base can be a substantially planar piece that is slit to define legs. The legs are bent in different directions during manufacturing to dimension the base to prevent passage of the base portion through the keeper plate opening.

The raised portion of the keeper plate can be dimensioned so as to constrict the movement of the legs of the base within the space, and thus the pivoting movement of the eye member, to a desired degree. The legs can be slit to a pre-determined length, and bent to a pre-determined position to result in a pre-determined pivotal range of motion of the outer end of the eye member. This range of motion alleviates problems of alignment between the eye member and the hinged hasp member, but also limits the range of motion to a desired degree so that the eye member is never too far from the hinged hasp member opening.

The invention is both inexpensive and easy to manufacture. The hasp fastener unit is assembled by forming a slit in the base portion of the eye member. The legs so formed are then bent to positions where they form a base portion which will not pass through the keeper plate opening. The two parts to the hasp fastener unit, the keeper plate and the eye member can be manufactured by conventional tool and die techniques.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
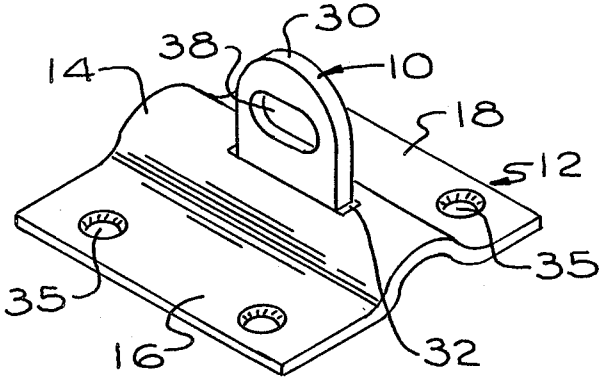
FIG. 1 is a perspective view of a hasp fastener unit according to the invention.
Figure 2:
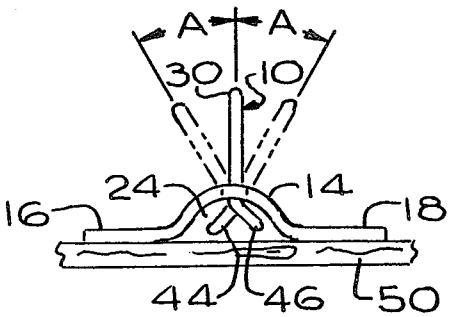
FIG. 2 is a side elevation of the hasp fastener unit, partially in phantom, where the angle A depicts the range of motion of the outer end of the eye member.
Figure 5:
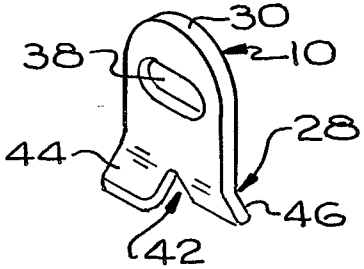
FIG. 5 is a perspective view of an eye member.
Figure 7:
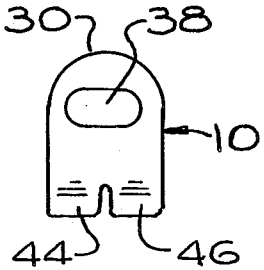
FIG. 7 is a side elevation of an eye member.

The hasp fastener unit includes an eye member 10 and a keeper plate 12. The keeper plate 12 can have a raised portion 14 between side flanges 16, 18. The raised portion 14 defines a space 24 between the raised portion 14 and the surface to which it is joined. The eye member 10 has a base portion 28. An outer end 30 of the eye member 10 extends through an eye member passage 32 in the raised portion 14. The side flanges 16, 18 of the keeper plate 12 have suitable means for securing the plate 12 to a surface, such as fastener openings 35 which are adapted to receive suitable fastening means such as screws. The fastener openings 35 receive the screw heads. The eye member 10 has an eye 38 to receive a fastener, such as a padlock, which secures the hinged hasp member over the eye member 10.

As depicted in FIGS. 2–7, the eye member 10 is moveable within the eye member passage 32. The base portion 28 preferably has at least one slit 42 defining at least two legs 44,46 which are positioned to prevent passage of the base portion 28 of the eye member 10 through the eye member passage 32. The legs 44, 46 of the eye member 10 are bent to a position which allows the eye member 10 to pivot through an angle A in either direction (phantom lines) from a perpendicular to the fixed surface 50 to which the keeper plate 12 is attached. This range of motion is desirable to avoid alignment problems between the eye member 10 and the hinged hasp member.

Figure 3:
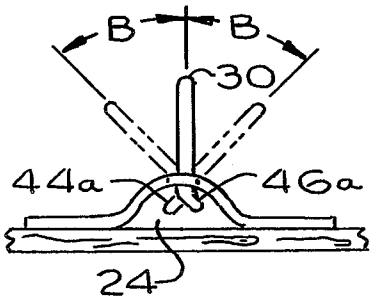
FIG. 3 is a side elevation of an alternative embodiment of the hasp fastener unit, partially in phantom, where the angle B depicts the range of motion of the outer end of the eye member.
Figure 8:
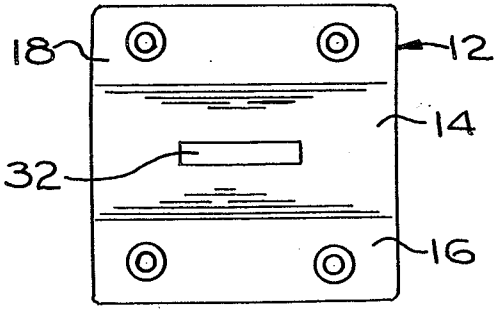
FIG. 8 is a plan view of a keeper plate.

FIG. 3 illustrates the larger range of motion of the outer end 30 of the eye member. This degree of movement is provided by legs **44*a*, 46*a*, which are just over the length of one-half the width of the eye member passage 32. This length is achieved by forming the slit 42 to a minimum length and bending the resulting legs 44*a*, 46*a*, to the minimum angle, relative to one another, that is required to prevent passage of the base portion 28 of the eye member 10 through the eye member passage 32 in the keeper plate 12. The eye member 10** can then pivot through the larger angle B.

Figure 4:
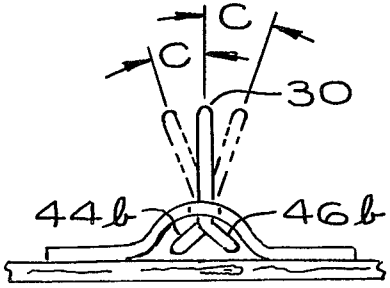
FIG. 4 is a side elevation of an alternative embodiment of the hasp fastener unit, partially in phantom, where the angle C depicts the range of motion of the outer end of the eye member.
Figure 6:
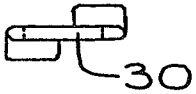
FIG. 6 is a plan view of an eye member.

FIG. 4 illustrates the smaller range of motion of the outer end 30 of the eye member 10. This range of motion is achieved by forming the slit 42 to a maximum length and bending the legs **44*b*, 46*b*to a maximum angle relative to one another where they abut the raised portion 14 of the keeper plate 12 to permit the eye member 10** to pivot through the smaller angle C.

The range of motion of the outer end 30 of the eye member is restricted by the dimension of the space 24 of the raised portion 14. The outer end 30 of the eye member 10 can only move as far as the restricted space 24 permits the legs 44, 46 to pivot. Once the leg 44 or 46 abuts an inside surface of the channel portion 14, the outer end 30 of the eye member 10 cannot pivot further in the same direction. It can thereby be seen that the amount of play desired in the outer end 30 of the eye member 10 can be adjusted easily during the manufacturing stage by adjusting the size of the eye member passage 32, the raised portion 14, or the length of the slit 42 and thus the length of the legs 44 and 46, and the angle to which they are bent.

The eye member 10 can be formed with more than two legs. It will be understood that two slits will produce a base portion with three legs, and three slits will result in four legs.

Most standard punch presses may be utilized to produce the keeper plate 12 with the raised portion 14, the fastener openings 35, and the eye member passage 32. Standard punch presses may be utilized to produce the eye member opening 38 and the slit 42. The legs 44,46 can be bent in different directions as indicated in FIG. 4 to prevent passage of the base portion 28 of the eye member 10 through the opening 32 in the keeper plate.

This invention can be embodied in other forms without departing from the spirit or essential attributes thereof, and accordingly, reference should be had to the following claims, rather than to the foregoing specification, as indicating the scope of the invention.

I claim:

1. A hasp fastener unit, comprising:

a keeper plate having a portion with an interior surface defining an open interior space, and having an eye member passage; and, an eye member having a base portion adapted to be positioned in said open interior space, and having an outer end portion extending through said eye member passage and being pivotal within said eye member passage, said base portion comprising at least one slit defining at least two legs, said legs being bent relative to one another and to said outer end portion so as to prevent passage of the base portion through the eye member passage, and being adapted to abut said interior surface of said keeper plate to define a pivotal range of motion within said eye member passage.

2. The unit of claim 1, wherein said interior surface of said keeper plate defines a channel.

3. The unit of claim 2, wherein said channel extends across the length of the keeper plate.

4. The unit of claim 3, wherein said keeper plate comprises fastening means for securing said keeper plate to a surface.

5. The unit of claim 4, wherein said fastening means comprise apertures in said keeper plate adapted to receive fasteners.

6. A hasp fastener unit, comprising:

a keeper plate having a raised portion defining a concave interior surface, and having an eye member passage; and, an eye member having a base portion adapted to be positioned in a space defined by said concave surface, and having an outer end extending through said eye member passage and being pivotal within said eye member passage, said base portion comprising at least one slit defining at least two legs, said legs being bent relative to one another and to said outer end portion so as to prevent passage of the base portion through the eye member passage, and being adapted to abut said interior surface of said keeper plate to define a pivotal range of motion within said eye member passage.

7. The unit of claim 6, wherein said raised portion of said keeper plate defines a channel..

8. The unit of claim 7, wherein said channel extends across the length of the keeper plate.

9. The unit of claim 8, wherein said keeper plate comprises fastening means for securing said keeper plate to a surface.

10. The unit of claim 9, wherein said fastening means comprise apertures in said keeper plate adapted to receive fasteners.

* * * * *